US012808172B2

(12) United States Patent
Garrels

(10) Patent No.: US 12,808,172 B2
(45) Date of Patent: Nov. 24, 2026

(54) BIDET

(71) Applicant: Kohler Co., Kohler, WI (US)

(72) Inventor: Clayton Garrels, Sheboygan, WI (US)

(73) Assignee: Kohler Co., Kohler, WI (US)

( * ) Notice: Subject to any disclaimer, the term of this patent is extended or adjusted under 35 U.S.C. 154(b) by 251 days.

(21) Appl. No.: 18/659,347

(22) Filed: May 9, 2024

(65) Prior Publication Data

US 2024/0392552 A1 Nov. 28, 2024

Related U.S. Application Data

(60) Provisional application No. 63/469,270, filed on May 26, 2023.

(51) Int. Cl.
*E03D 9/08* (2006.01)

(52) U.S. Cl.
CPC ..... *E03D 9/08* (2013.01)

(58) Field of Classification Search
CPC .. E03D 9/08; E03D 5/10; E03D 11/02; E03D 11/13; F03B 13/00
USPC ..... 4/420.2, 420, 420.3, 420.4, 447, 448
See application file for complete search history.

(56) References Cited

U.S. PATENT DOCUMENTS 2,344,561 A * 3/1944 Popil ..... E03D 9/08 248/278.1
3,605,124 A * 9/1971 Marcard et al. ..... E03D 9/08 4/420.2
3,662,407 A * 5/1972 Colucci ..... E03D 9/085 392/475
4,205,402 A * 6/1980 Miller ..... E03D 9/085 4/447
4,406,025 A * 9/1983 Huck ..... E03D 9/08 4/443
4,642,820 A * 2/1987 Boring, Jr. ..... E03D 9/08 4/420.4
5,359,736 A * 11/1994 Olivier ..... E03D 9/08 4/443
5,685,028 A * 11/1997 Miller ..... E03D 9/085 604/259
5,754,988 A * 5/1998 Presa ..... E03D 9/085 4/443
6,843,432 B1 * 1/2005 Philpott ..... A47K 7/08 239/289
7,284,285 B2 * 10/2007 Scalzi ..... E03D 9/08 4/213
7,543,339 B1 * 6/2009 Harris ..... E03D 1/01 4/445
8,261,377 B2 * 9/2012 Oh ..... E03D 9/08 4/420.1
9,049,970 B2 6/2015 Dorra
(Continued)

FOREIGN PATENT DOCUMENTS

CA 3151864 A1 * 9/2022 ..... A61H 35/00
CN 215977558 U * 3/2022 ..... E03D 9/08
(Continued)

*Primary Examiner* — Lori L Baker
(74) *Attorney, Agent, or Firm* — Lempia Summerfeld Katz LLC

(57) ABSTRACT

A bidet assembly includes a base configured to be coupled to a toilet, a wand extending from the base, a user control interface coupled to the base, and cords configured to move the wand when the user control interface is moved. The cords may extend from the user control interface to the wand.

13 Claims, 14 Drawing Sheets

(56) References Cited

U.S. PATENT DOCUMENTS

| | | | | |
|---|---|---|---|---|
| 9,194,115 | B1 * | 11/2015 | Green | E03D 13/00 |
| 9,283,144 | B2 | 3/2016 | Bickerstaffe et al. | |
| 9,528,254 | B2 | 12/2016 | Kuang | |
| 9,594,500 | B2 * | 3/2017 | Clements | G06F 3/017 |
| 9,595,185 | B1 * | 3/2017 | Hall | G01G 19/50 |
| 9,822,519 | B2 * | 11/2017 | Hall | E03D 9/08 |
| 9,856,637 | B2 | 1/2018 | Kontogounis et al. | |
| 9,930,232 | B2 * | 3/2018 | Peng | H04N 23/50 |
| 9,976,293 | B2 | 5/2018 | Bickerstaffe | |
| 10,125,482 | B2 | 11/2018 | Hashimoto | |
| 10,407,888 | B2 * | 9/2019 | Hall | G06V 40/10 |
| 10,881,252 | B2 * | 1/2021 | Veurink | E03D 9/08 |
| 10,982,422 | B2 * | 4/2021 | Schwab | A61M 3/06 |
| 11,242,192 | B2 * | 2/2022 | Sylvia | B65D 83/386 |
| 11,253,114 | B2 * | 2/2022 | Schwab | E03D 9/08 |
| 11,347,354 | B1 | 5/2022 | Clements | |
| 11,607,087 | B2 * | 3/2023 | Hall | E03D 9/03 |
| 11,808,023 | B2 * | 11/2023 | Lin | B05B 15/70 |
| 12,123,185 | B2 * | 10/2024 | Fang | A47K 13/12 |
| 12,286,781 | B2 * | 4/2025 | Lee | B05B 1/16 |
| 12,440,193 | B2 * | 10/2025 | Kashyap | G01N 33/4833 |
| 2012/0318386 | A1 | 12/2012 | Guzman | |
| 2017/0130440 | A1 | 5/2017 | Novick | |
| 2018/0002911 | A1 * | 1/2018 | Hall | E03C 1/055 |
| 2018/0062481 | A1 | 3/2018 | Alexander | |
| 2019/0186116 | A1 * | 6/2019 | Schwab | B05B 1/02 |
| 2019/0203454 | A1 * | 7/2019 | Hall | E03C 1/057 |
| 2019/0368182 | A1 * | 12/2019 | Ethier | E03D 9/085 |
| 2020/0178738 | A1 * | 6/2020 | Schwab | A61M 11/08 |
| 2021/0023580 | A1 | 1/2021 | Lim | |
| 2021/0293013 | A1 * | 9/2021 | Schrant | E03D 9/08 |
| 2022/0049483 | A1 | 2/2022 | Montgomery | |
| 2026/0015846 | A1 * | 1/2026 | Thomas | E03D 5/10 |

FOREIGN PATENT DOCUMENTS

| | | | | |
|---|---|---|---|---|
| DE | 112020002395 | T5 * | 2/2022 | H04N 23/56 |
| DE | 112022000375 | T5 * | 10/2023 | B05B 1/12 |
| EP | 3985188 | A1 * | 4/2022 | E03D 1/00 |
| GB | 1472666 | A | 5/1977 | |
| WO | WO-9208851 | A1 * | 5/1992 | E03D 9/08 |
| WO | WO-2007004790 | A1 * | 1/2007 | E03D 9/08 |
| WO | 2017092055 | A1 | 6/2017 | |
| WO | 2018114050 | A1 | 6/2018 | |
| WO | WO-2020028798 | A1 * | 2/2020 | G06Q 10/20 |
| WO | WO-2021247865 | A1 * | 12/2021 | G01N 33/493 |
| WO | 2022051605 | A1 | 3/2022 | |
| WO | WO-2023064518 | A2 * | 4/2023 | E03D 11/10 |

* cited by examiner

BIDET

This application claims priority benefit of Provisional Application No. 63/469,270 filed May 26, 2023, which is hereby incorporated by reference in its entirety.

FIELD

The present application relates generally to the field of bidets. More specifically, the present disclosure relates to manual control of a bidet wand position.

BACKGROUND

A toilet may include a bidet wand to wash the underside of a user, thereby improving the user experience. A toilet may be manufactured to include an integrated bidet, or a bidet may be installed on a toilet as an after-market add-on product by a party other than the toilet's manufacturer. Bidets often include additional functionality to further improve user experience. For example, a bidet may include motors for movement of a bidet wand, a water heater, a drying fan, lights for water sterilization, and the like. However, these additional features often require the inclusion of a power supply and electrical circuit(s), increasing the cost, size, and failure points of the bidet.

BRIEF DESCRIPTION OF THE DRAWINGS

Objects, features, and advantages of the present disclosure should become more apparent upon reading the following detailed description in conjunction with the drawing figures, in which:

FIG. 1 illustrates a toilet including a tank and FIG. 2 illustrates a tankless toilet according to exemplary embodiments of the present disclosure.

The figures illustrate certain exemplary embodiments of the present disclosure in detail. It should be understood that the present disclosure is not limited to the details and methodology set forth in the detailed description or illustrated in the figures. It should be understood that the terminology used herein is for the purposes of description only and should not be regarded as limiting.

DETAILED DESCRIPTION

Described herein are apparatuses, systems, and methods for moving a bidet wand. In some examples, bidet assemblies described herein provide for manual, mechanical movement of a bidet wand by a user. A user may operate a bidet control interface to move or change the position of a bidet wand and thus change a direction in which water is dispensed from an outlet disposed on the wand. A plurality of cords may connect the bidet control interface to the bidet wand. As the bidet control interface is operated, for example, moved by either pushing or pulling, one or more of the plurality of cords may push or pull the bidet wand, moving the bidet wand. In some examples, each of the plurality of cords may be attached to the control interface at different locations, for example, proximate to different sides of the bidet control interface. Additionally, each of the plurality of cords may be attached to the bidet wand at different locations. Accordingly, movement of different sides of the control interface may cause different cords to exert a force (e.g., push, pull) on the wand at different locations, causing the wand to move in different directions.

In some examples, the apparatuses and systems described herein may further include a hydroelectric turbine configured to generate an electric current as water flows through the bidet to be dispensed out of the wand. The turbine may be configured to power, for example, a drying fan, an ultraviolet light, and the like. Accordingly, the present disclosure provides a bidet assembly including various functionality without the need for an external power supply (e.g., wall outlet, battery). Thus, allowing the bidet assembly to have a compact and low cost design.

Figure 1:
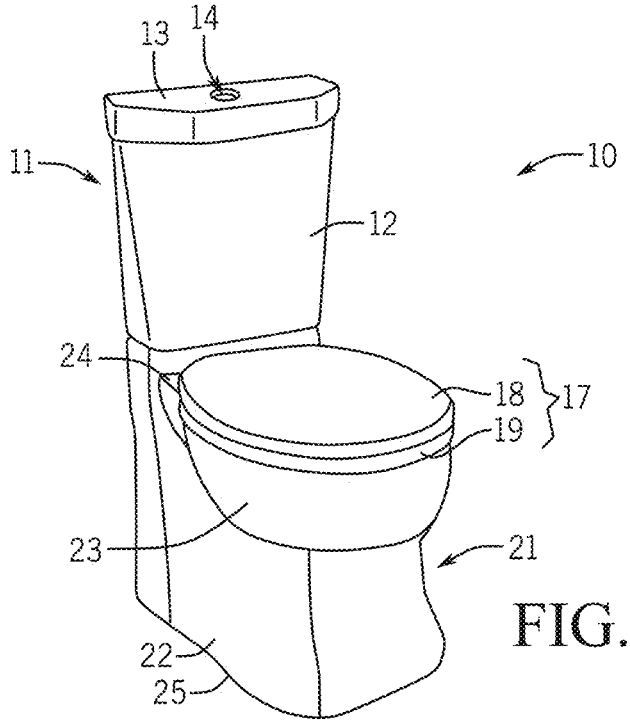
FIGS. 1 and 2 illustrate perspective views of exemplary embodiments of toilets according to the present disclosure. Specifically.
Figure 2:
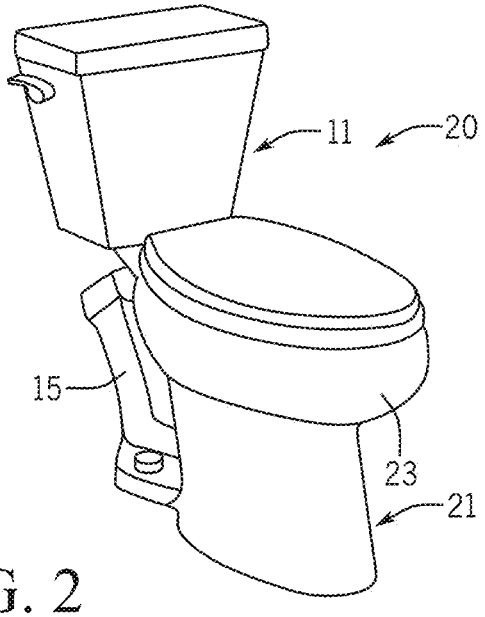

FIGS. 1 and 2 illustrate toilets according to exemplary embodiments of the present disclosure. FIG. 1 illustrates an exemplary embodiment of a skirted toilet 10 that includes a tank 11, a pedestal 21, a seat assembly 17 and a coupling or mounting assembly. The tank 11 may include a reservoir 12 for storing the water used during operational (or flushing) cycles, a lid (or cover) 13 for providing selective access into the reservoir 12, and an actuator 14 that is configured to initiate an operational cycle when activated. The actuator 14 or flush mechanism may be a button configured to activate when depressed (or pulled) a predetermined distance or when touched, a lever configured to activate when rotated a predetermined angular travel, or any suitable device configured to activate based upon an input manipulation by a user.

It should be noted that the shapes and configurations of the tank, pedestal, seat assembly, and the internal components (including the trapway and other features) may vary from the embodiments shown and described herein, and that the embodiments disclosed herein are not intended as limitations. It should be noted that various components of the toilet may be made of vitreous china. It should be noted that various components of the toilet may be polymeric and/or over molded or otherwise fixed to the toilet. It should be noted, for example, that although the exemplary embodiment of the toilet 10 is shown configured with the tank 11 formed separately from the pedestal 21 and later coupled to the pedestal, the tank may be integrally formed with the pedestal as a one-piece design. In other words, the toilet may be a one-piece design, a two-piece design, or have any suitable configuration. The toilet disclosed herein may have a wide variety of skirted toilet configurations, and all such configurations are intended to be encompassed herein. The following description of various toilet features is therefore intended as illustration only of one possible embodiment, and it should be understood by those reviewing the present description that similar concepts or features may be included in various other embodiments.

The tank 11 may include an inlet opening configured to receive water from a coupled water supply, such as from a hose (e.g., line, tube). The tank 11 may also include an inlet valve assembly or other device configured to control the flow of water from the water supply into the tank through the inlet opening. Within the tank 11 may be provided a float device for controlling the inlet valve assembly, such as by opening the valve to refill the reservoir 12 of the tank 11 after an operational cycle and closing the valve when the water in the reservoir 12 reaches a preset volume or height. The tank 11 may also include an outlet opening configured to transfer (e.g., conduct) the water stored in the reservoir 12 of the tank to the pedestal 21 upon activation of the actuator 14. The pedestal 21 may include toilet bowl 23. The tank 11 may include an outlet valve assembly or other device configured to control the flow of water from the tank into the pedestal 21 through the outlet opening.

The pedestal 21 of the toilet 10 may include a wall 22 having any suitable shape that is configured to form a bowl 23 having an opening formed by an upper rim at the top of the opening. The pedestal 21 may also be configured to include a plurality of walls having varying shapes that together form a bowl having an opening formed by a rim. The wall 22 of the pedestal may extend downward and/or rearward from the bowl 23 to form a lower portion 25 configured to support the pedestal 21 and the toilet 10. The lower portion 25 may be formed by the end (e.g., lower rim) of the wall 22, or may include a member that extends generally in a horizontal plane from one or more than one end of the wall. The pedestal 21 may also include a top member 24 that extends between two sides of the wall 22 (or between two opposing walls) and is provided rearward (or behind) the bowl 23, wherein the top member 24 forms a plateau for supporting the tank 11, such as the bottom surface of the reservoir 12 of the tank 11. The top member 24 may include an inlet opening that may be aligned with the outlet opening of the tank 11, such as when the tank 11 is coupled to (or resting above) the pedestal 21, wherein water is selectively transferred (e.g., conducted) from the tank 11 through the outlet opening of the tank to the pedestal 21 through the inlet opening of the pedestal 21, when the toilet is activated through the actuator 14. The outlet valve assembly may control the flow of water from the tank to the pedestal. The toilet may also include a gasket or seal that is provided between the tank 11 and the pedestal 21 to prohibit leaking. For example, a gasket may be provided between the outlet opening of the tank and the inlet opening of the pedestal to prohibit leaking between the tank and the pedestal.

The plateau or upper surface formed by the top member 24 of the pedestal 21 may also provide for coupling of the seat assembly 17 to the pedestal 21 of the toilet 10. For example, the top member 24 may include one or more than one opening, wherein each opening is configured to receive a fastening device (e.g., bolt, screw, etc.) to couple (e.g., attach) the seat assembly 17 to the top member 24 of the pedestal 21. As another example, the top member 24 may include one or more than one fastening device (e.g., bolts, recessed nuts, etc.) integrally formed therein (i.e., already provided connected or coupled to the pedestal 21), wherein the fastening device may be used to couple or secure at least a portion of the seat assembly 17 to the pedestal 21. The seat assembly 17 may include a hinge, hinge shoulders configured to receive a fastener, a seat coupled to the hinge and a cover coupled to the hinge.

The bowl 23 of the pedestal 21 may be configured to include a receptacle (e.g., sump) and an outlet opening, wherein the water and waste is collected in the receptacle until being removed through the outlet opening, such as upon activation of the actuator 14. The pedestal 21 may also include a pedestal internal passageway, such as a trapway, that connects the outlet opening or discharge outlet of the bowl 23 to a drain or soil pipe. The passageway, or trapway, generally includes a first portion, a second portion, and a weir separating the first and second portions. The first portion of the passageway may extend from the outlet opening of the bowl 23 at an upwardly oblique angle to the weir. The second portion of the passageway may extend from the weir downwardly to the exiting device, such as the drain or soil pipe.

Between operational cycles (e.g., flush cycles) of the toilet 10, the water (and waste) is collected in the first portion of the trapway (in addition to the receptacle of the bowl), such that the weir prohibits the water from passing past the weir and into the second portion of the trapway. A flushing cycle may begin upon activation of the actuator 14. Upon activation of the actuator, additional water may be discharged into the bowl 23 of the pedestal 21, resulting in the flushing action and waste removal through the soil pipe. The flushing cycle may include generation of a siphon to assist the flushing action and waste removal.

The seat assembly 17 may include a cover member 18 (e.g., lid), a seat member 19 (e.g., ring member), and a hinge. The seat member 19 may be configured to include an annular member that encircles an opening, wherein the annular member provides a seating surface for the user of the toilet 10. The seat member 19 may also be pivotally coupled (e.g., attached) to the hinge, wherein the seat member may rotate (or pivot) about the hinge, such as between a first lowered or seated position and a second raised or upright position. The cover member 18 may be configured to be round, oval, or any other suitable shape. Typically, the profile or shape of the outer surface of the cover member will be configured to match (i.e., to be substantially similar) to the profile of the outer surface of the seat member to improve the aesthetics of the seat assembly and toilet. The cover member 18 may also be coupled to the hinge, wherein the cover member may rotate (or pivot) about the hinge, such as between a first lowered or down position and a second raised or upright position. The cover member 18 may be provided above the seat member in the down position to thereby cover the opening of the seat member 19, as well as to conceal the inside of the bowl 23 of the pedestal 21. The cover member 18 may be configured to rest against the outside surface of the tank 11, when the cover member 18 is in the upright position, such that the cover member 18 remains in the upright position in order for a user to sit upon the seat member 19.

FIG. 2 illustrates a non-skirted toilet 20 according to another exemplary embodiment of the present disclosure. The internal components, including the trapway 15, are visible in the pedestal 21 of non-skirted toilet 20. It should be noted that the devices, methods, and systems described herein may include and/or be used with both skirted and non-skirted toilets. It should further be noted that devices, methods, and systems described herein may include or be used with both toilets including tanks and tankless toilets. A waterline may supply a tankless toilet with water during a flush cycle.

Figure 3:
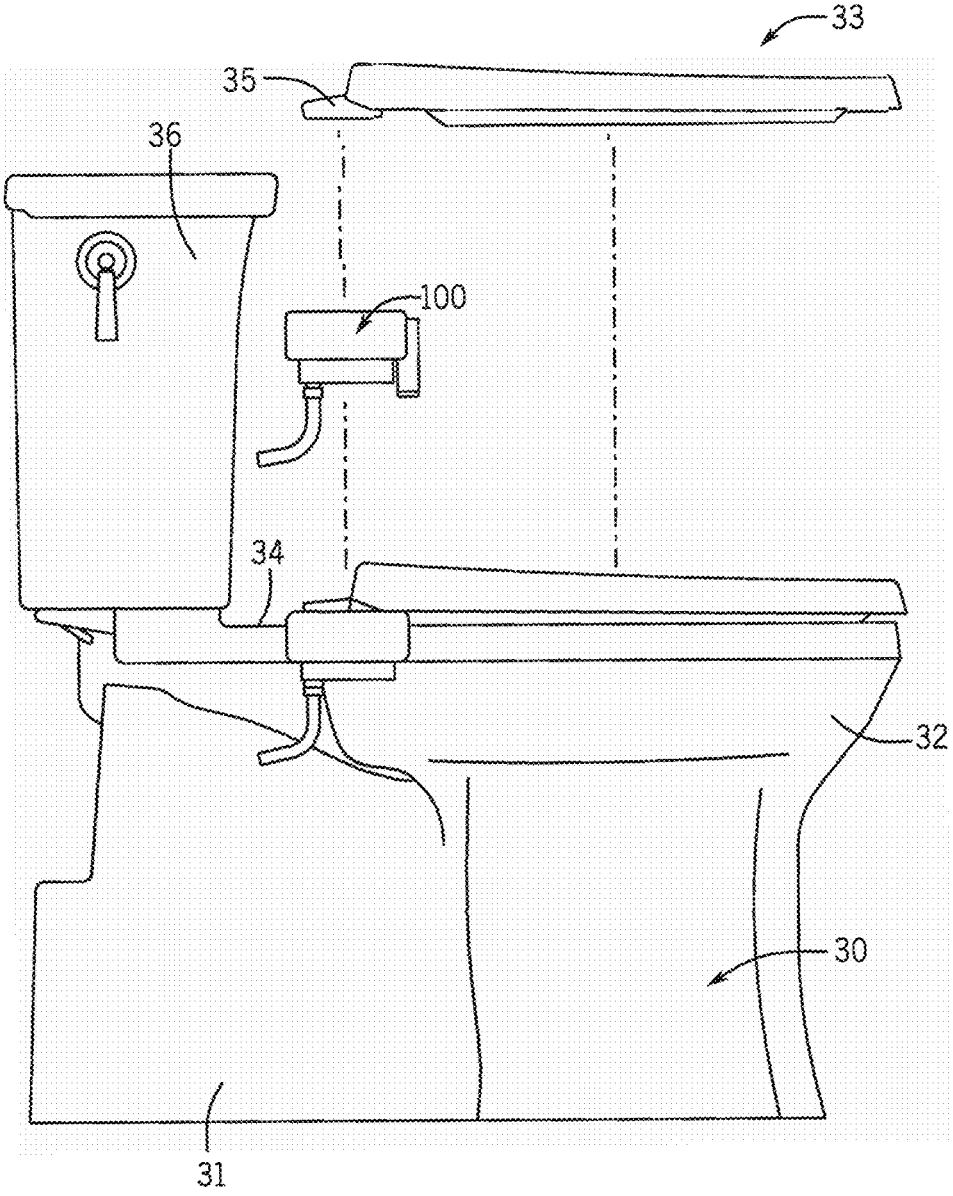
FIG. 3 illustrates a side view of a toilet including a bidet assembly in accordance with one example of the present disclosure.

FIG. 3 illustrates a toilet 30 including a bidet assembly 100 in accordance with one example of the present disclosure. As illustrated in FIG. 3, the toilet includes a pedestal 31 having a bowl 32 and a seat assembly 33. As illustrated, the toilet 30 of FIG. 3 includes a tank 36; however, as mentioned above the present disclosure is not limited thereto and a toilet in accordance with another example of the present disclosure may be a tankless toilet. As illustrated in FIG. 3, the bidet assembly 100 may be coupled to an upper surface 34 of the pedestal 31. For example, as illustrated in FIG. 3, the bidet assembly 100 may be disposed between the upper surface 34 of the pedestal 31 and the seat assembly 33. Specifically, a fastener (e.g., bolt, screw, rivet) may extend through a hinge shoulder 35 and a mounting hole 112 (See FIG. 6) of the bidet assembly 100 into the pedestal 31, coupling the bidet assembly 100 and the seat assembly 33 to the pedestal 31.

In some examples, the toilet 30 may be manufactured to include the bidet assembly 100. For example, the pedestal 31 and bidet assembly 100 may be formed as a single integral component. In another example, the bowl 32 and the bidet assembly 100 may be formed as a single integral component. In other examples, the bidet assembly 100 may be manufactured and attached to the pedestal 31 by the toilet's manufacturer. However, it is also envisioned that the bidet assembly 100 can be sold as an after-market add-on product capable of being installed on the toilet by a party other than the toilet's manufacturer.

Figure 4:
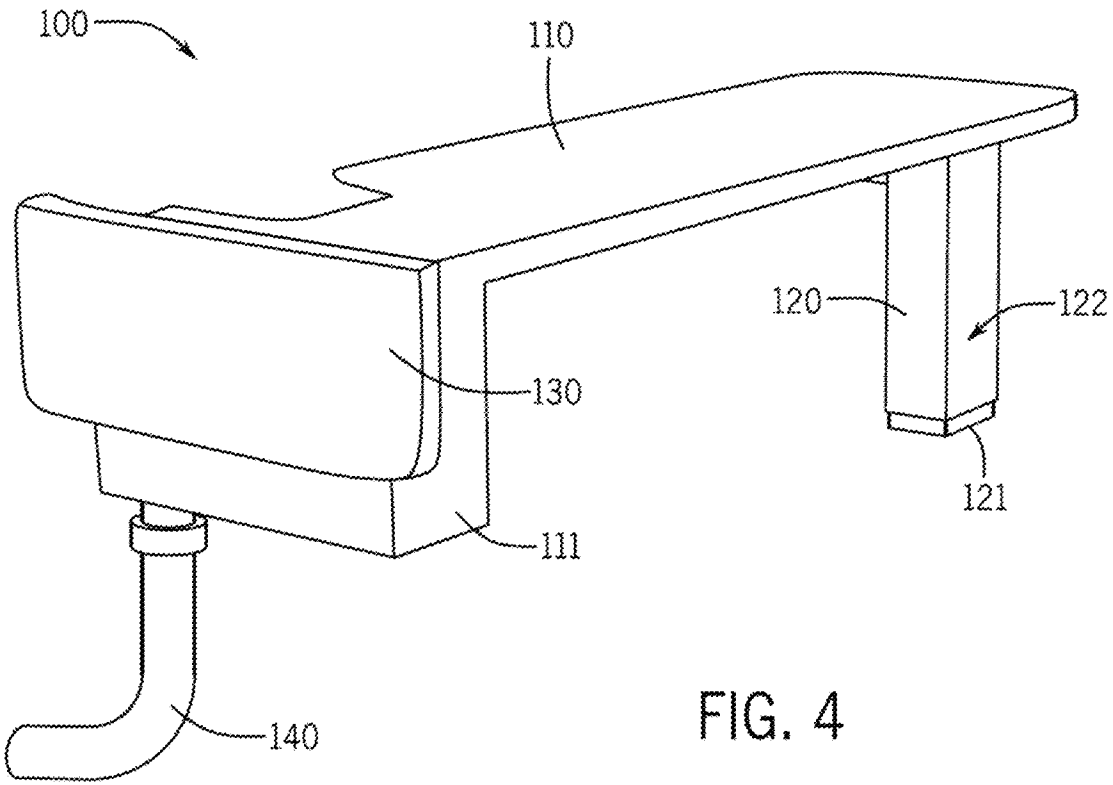
FIG. 4 illustrates a perspective view of a bidet assembly in accordance with one example of the present disclosure.
Figure 5:
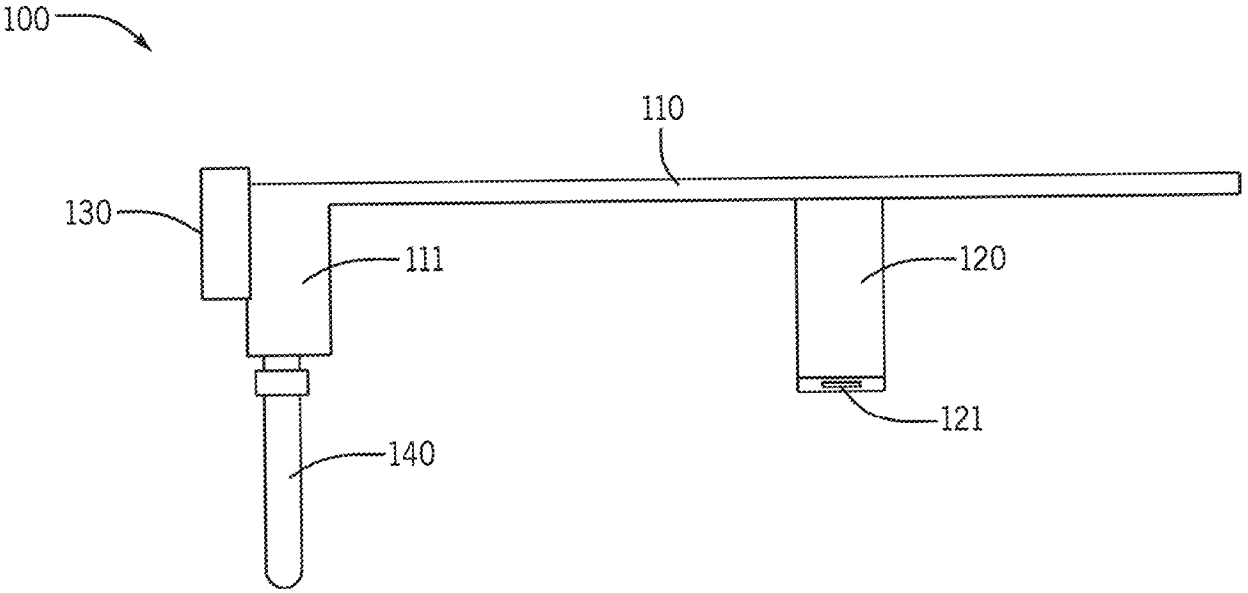
FIG. 5 illustrates a front view of a bidet assembly in accordance with one example of the present disclosure.
Figure 6:
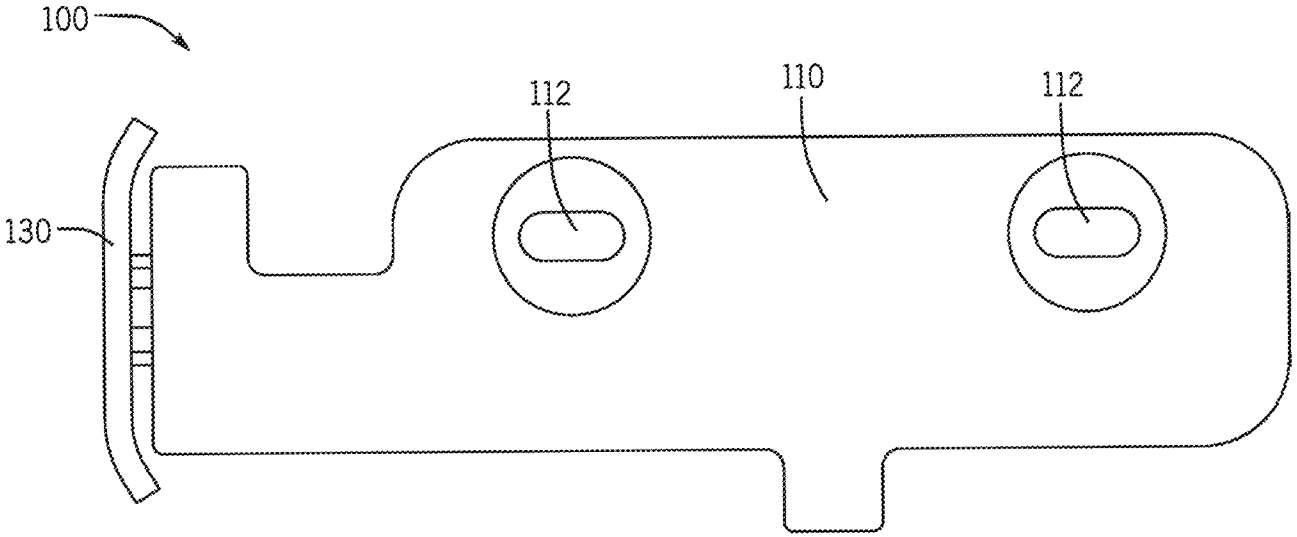
FIG. 6 illustrates a top view of a bidet assembly in accordance with one example of the present disclosure.

Referring generally to FIGS. 4-6 a bidet assembly 100 in accordance with one example of the present disclosure is illustrated. FIG. 4 illustrates a perspective view, FIG. 5 illustrates a front view, and FIG. 6 illustrates a top view of the bidet assembly 100. As illustrated in FIGS. 4-6, the bidet assembly 100 includes a base 110, a bidet wand 120, a user control interface 130, and a supply hose 140. The base 110 may be configured to contact the upper surface 34 of the pedestal 31, supporting the bidet assembly 100 when the bidet assembly is installed or coupled to the toilet 30. The base 110 may be comprised of a plastic, such as polypropylene, polyethylene, polycarbonate, or other similar materials.

As illustrated in FIGS. 4 and 5, the bidet assembly 100 includes a wand 120 extending (e.g., downward and/or outward) from the base 110. In some examples, a flexible or elastic sleeve may be disposed between the base 110 and the wand 120. When the bidet assembly 100 is coupled to the toilet 30, the wand 120 may extend into bowl 32 of the toilet 30. For example, the wand may extend downward and/or inward toward a center of the bowl 32. The wand may include an inlet and a wand channel extending from the inlet to a wand outlet 121 configured to dispense water. The wand 120 may have a proximal end disposed at and/or coupled to the base 110 and a distal end disposed further away from the base 110 than the proximal end. The wand outlet 121 may be disposed at or near a distal end 122 of the wand 120. In some examples, the wand outlet 121 may include a nozzle or fluidics device configured to condition a flow of water dispensed from the wand outlet 121. For example, the nozzle or fluidics device may be configured to condition the flow of water to have a fan shape spray, a cone shape spray, solid stream spray, and/or an oscillating spray pattern. The shape of the wand 120 may vary. For example, the wand 120 may have a rectangular shape, cylindrical shape, or the like.

As described herein, the bidet wand 120 is configured to change positions in response to operation of the user control interface 130. One or more of a plurality of cords 250, a pulley 260, and a plurality of cables 270 (See FIG. 7) may be used to change the position of the wand 120. Operation of the user control interface 130 to control movement of the bidet wand 120 is described in detail hereinafter with reference to FIG. 7. The wand 120 may be comprised of a plastic such as polypropylene, polyethylene, polycarbonate, or other similar materials. Additionally, in some examples, the bidet wand 120 may include an elastic sleeve (see FIG. 12). The elastic sleeve may couple the bidet wand 120 to the base 110 of the bidet assembly 100. The elastic sleeve may be comprised of a rubber, a silicone rubber, a flexible polyvinyl chloride (PVC) or rubber-like resin. For example, the elastic sleeve may be comprised of a thermoplastic elastomer (TPE) such as thermoplastic vulcanizate (TPV), styrenic block copolymers (TPE-S), thermoplastic polyolefins (TPE-O), thermoplastic polyurethanes (TPE-U), thermoplastic copolyesters (TPE-E), melt processable rubber (MPR), thermoplastic polyether block amides (TPE-A), ethylene vinyl acetate (EVA) or a combination thereof.

As illustrated in FIGS. 4-6, the bidet assembly 100 further includes a user control interface 130. In some examples, as illustrated in FIG. 4, the user control interface 130 may be disposed on a side of the base 110. For example, as illustrated in FIG. 2, the base 110 may include a vertical portion 111 extending downward from an end of the base 110. The vertical portion 111 may extend downward so as to be disposed adjacent to the pedestal 31 when the bidet assembly 100 is coupled to the toilet 30. The user control interface 130 may extend outward, away from the vertical portion 111. In other examples, the user control interface 130 may be disposed on a horizontal surface and extend upward, away from the horizontal surface on which the control interface 130 is disposed. As described herein, operation or movement of the user control interface 130 is configured to move the bidet wand 120. The user control interface 130 may be movably coupled to the base 110. Operation of the user control interface 130 and movement of the bidet wand 120 are described in detail hereinafter with reference to FIG. 7. In some examples, the user control interface 130 may include an elastic or biasing member configured to return the user control interface to a starting or home position after the user control interface 130 is moved by a user.

The bidet assembly 100 further includes a supply hose 140 configured to supply water to the bidet wand 120. In some examples, the supply hose 140 may be in fluid communication with a tank 36 of the toilet, so as to be supplied with water from the tank 36 during a flush cycle of the toilet. For example, the supply hose 140 may be in fluid communication with a flush valve disposed in the tank 36 or a rim channel of the pedestal 31 so as to receive water stored in the tank during a flush cycle. In some examples, for example, when a tankless or line pressure toilet is used, the supply hose 140 may be in fluid communication with a building (e.g., commercial, residential) plumbing network, so as to receive water from the building water network. In these examples, a valve may be used to control the flow of water from the plumbing network out of the outlet 121 of the wand 120. In some examples, the base 110 may include a channel formed therein configured to convey a flow of water from the supply hose 140 to the bidet wand inlet. In other examples, the supply hose 140 may be directly coupled to the bidet wand inlet. A valve may be located, for example, in the base 110 or in the bidet wand 120 to selectively control a flow of water from the plumbing network.

Referring to FIG. 6, a top view of the bidet assembly 100 is illustrated. In some examples, as shown in FIG. 6, the base 110 may include one or more mounting holes 112 extending therethrough. The two or more mounting holes 112 may be configured to align with two or more holes in the pedestal of the toilet 30. Each mounting hole 112 may be configured to receive a fastener. For example, a fastener (e.g., bolt, screw, rivet) may extend through the seat assembly (e.g., hinge shoulder 35) and the mounting hole 112 into the pedestal 31, securing the bidet assembly 100 and the seat assembly 33 to the toilet 30.

Figure 7:
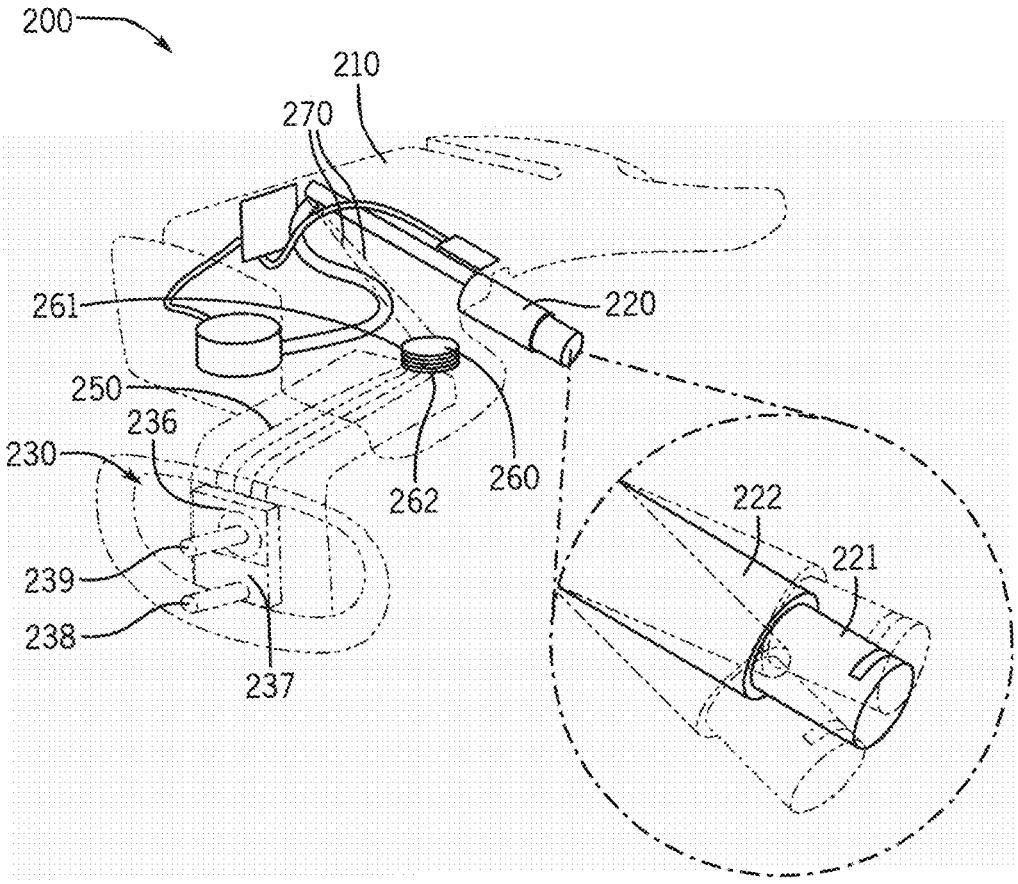
FIG. 7 illustrates a perspective view of a bidet assembly in accordance with one example of the present disclosure.

Referring to FIG. 7, a bidet assembly 200 in accordance with one example of the present disclosure is illustrated. Generally, the bidet assembly 200 includes a base 210, a bidet wand 220, and a user control interface 230. The base 210, wand 220, and user control interface 230 may be the same as the base 110, wand 120, and user control interface 130, respectively, described above with respect to FIGS. 4-6. The bidet assembly 200 may further include a plurality of cords 250, a pulley assembly 260, and a plurality of cables 270.

Referring generally to FIG. 7, the user control interface 230 may be mechanically connected to the bidet wand 220 via the plurality of cords 250, the pulley assembly 260, and the plurality of cables 270. The user control interface 230 may be mechanically connected to the bidet wand 220 such that operation or movement of the user control interface 230 causes the wand 220 to move. Specifically, the user control interface 230 may be mechanically connected to the bidet wand 220, such that when a user pushes or pulls, for example, a side of the user control interface 130 (e.g., toward or away from the pedestal 31, respectively) the wand 220 moves. The user control interface 230 may operate similar to a joystick, such that pushing a side of the user control interface 230 causes the bidet wand 220 to move in a first direction and pushing an opposite side of the user control interface 230 causes the bidet wand 220 to move in a second opposite direction. In some examples, a user may operate the user control interface 230 by pulling on a side of the user control interface 230; pulling a side of the user control interface may have the same effect as pushing an opposite side of the user control interface 230.

In one example, the bidet assembly 100 may be configured such that operation or movement of the user control interface 230 in the directions as follows causes the bidet wand 220 to move as follows. When a top side of the user control interface 230 is pushed (e.g., toward toilet 30) the bidet assembly (e.g., cords 250, pulley assembly 260, cables 270) may cause the wand to move upward. Conversely, when a bottom side of the user control interface 230 is pushed, the bidet assembly 200 may cause the wand to move downward. When a front side of the user control interface 230 is pushed, the bidet assembly 200 may cause the bidet wand 220 to move to the left. Conversely, when a back side of the user control interface 230 is pushed, the bidet assembly 200 may cause the bidet wand to move to the right. As mentioned above, pulling a side of the user control interface (e.g., away from the toilet) may the same effect as pushing an opposite side of the user control interface 230.

In some examples, a user may operate the user control interface 230 such that multiple sides of the user control interface are moved or displaced at the same time, causing the bidet wand to be moved or displaced along multiple axis (e.g., upward and to the right). A user may operate the user control interface and hold the user control interface at a position corresponding to a desired position of the bidet wand 220 for the duration of time that water is dispensed from the bidet wand 220, for example, the duration of a flush cycle. When a user releases the user control interface 230, a flexible sleeve disposed between a portion of the wand 220 moved (e.g., by operation of the user control interface 230) and the base 110 or a remaining (e.g., stationary) portion of the wand 120 may return the bidet wand 220 (e.g., a moved portion of the wand 220) to an original, starting, or home position and the plurality of cables 270, pulley assembly 260, and plurality of cords 250 may transmit force(s) to the user control interface 230, causing the user control interface to return to an original, starting, or home position. In another example, when a user releases the user control interface 230 an elastic or biasing member included in the user control interface 230 may return the user control interface 230 to an original, starting, or home position and the plurality of cables 270, pulley assembly 260, and the plurality of cords 250 may transmit force(s) to the wand 220 (e.g., a moved portion of the wand 220), causing the wand 220 to return to an original, starting, or home position.

In some examples, as illustrated in FIG. 7, the plurality of cords 250 may extend from the user control interface 230 to the pulley assembly 260. Specifically, one end (e.g., a first end) of each of the plurality of cords may be attached to the user control interface 230 and another end (e.g., second end) of each of the plurality of cords may be attached to the pulley assembly 260. In some examples, the bidet assembly 200 may further include a plurality of sheaths (e.g., sheath 451 illustrated in FIGS. 9 and 10). A sheath may surround each of the cords 250. Each cord 250 may be free to move within the sheath and the sheath may direct or guide the cord 250 as the cord 250 moves within the sheath. Specifically, the sheath may direct the cords such that the cords may apply a pushing force to the pulley assembly 260.

Referring to FIG. 7, one end (e.g., a first end) of each of the plurality or cords 250 may be attached to a different location or position on the user control interface 230. For example, the bidet assembly may include four cords 250 and an end (e.g., a first end) of a different one of each of the plurality of cords 250 may be attached to the first location 236, the second location 237, the third location 238, and the fourth location 239, respectively. Each of the locations 236, 237, 238, and 239 may correspond to (e.g., be located nearest to) a different side of the user control interface 230. For example, the first location 236 may correspond to a top side, the second location 237 may correspond to a front side, the third location 238 may correspond to a bottom side, and the fourth location 239 may correspond to a back side of the user control interface 230. In some examples, cords 250 attached to locations of the user control interface 230 corresponding to opposite sides of the user control interface 230 may be configured to control movement of the wand 320 about the same axis, for example, a vertical or horizontal axis.

In some examples, the locations 236, 237, 238, 239 at which the plurality of cords 250 are attached or coupled to the user control interface 230 may be disposed along a pair of perpendicular axes. Two of the locations may be disposed along each of the pair of perpendicular axes. For example, the first location 236 and the third location 238 may be disposed along a vertical axis (the first and third locations 236, 238 may be disposed on opposite sides of horizontal axis) and the second location 237 and the fourth location 239 may be disposed along the horizontal axis (the second and fourth locations 237, 239 may be disposed on opposite sides of the vertical axis). Cords 250 attached to locations on the same axis may be configured to control movement of the wand 220 about the same axis of the wand 220.

Still referring to FIG. 7, in some examples, the bidet assembly 200 includes a pulley assembly 260. The pulley assembly 260 may be disposed within a chamber or internal space in the base 210. In some examples, the pulley assembly 260 includes two pulleys, for example, a first pulley 261 and a second pulley 262. In other examples, as described below with respect to FIG. 8, the pulley assembly 360 may include a single pulley. The pulley assembly may include any number of pulleys. In some examples, as illustrated in FIG. 7, the pulley assembly 260 may include two pulleys 261, 262 adjacent to one another and configured to rotate about the same axis.

Still referring to FIG. 7, another end (e.g., second end) of each of the plurality of cords may be attached to the pulley assembly 360. For example, two cords of the plurality of cords 250 may be attached to each of the pulleys (e.g., first pulley 261, second pulley 262). In some examples, cords 250 attached to locations (e.g., 236-239) on opposite sides (e.g., for example, top and bottom, front and back) of the user control interface 330 may be attached to opposite sides of the same pulley. In some examples, cords 250 attached to locations of the user interface 230 disposed along the same axis of a pair of perpendicular axes along which the locations (e.g., 236-239) are arranged may be attached to opposite sides of the same pulley.

Specifically, for example, a cord 250 attached to the user control interface 230 at a first location 236 corresponding to the top side of the user control interface 230 and a cord 250 attached to the user control interface 230 at a third location 238 corresponding to a bottom side of the user control interface 230 may each be attached to opposite sides of the first pulley 261. Accordingly, when a top side of the user control interface 230 is pushed, the cord 250 attached at the first location 236 may push the first pulley 261 to rotate in a first direction and the cord 250 attached to the third location 238 may pull the first pulley 261 in the first direction. Conversely, when a bottom side of the user control interface 230 is pushed, the cord 250 attached at the third location 238 may push the first pulley 261 to rotate in a second direction opposite the first direction and the cord 250 attached to the first location 236 may pull the first pulley 261 in the second direction.

Similarly, a cord 250 attached to the user control interface 230 at the second location 237 corresponding to the front side of the user control interface 230 and a cord 250 attached to the user control interface 230 at the fourth location 239 corresponding to a back side of the user control interface 230 may each be attached to opposite sides of the second pulley 262. Accordingly, when a front side of the user control interface 230 is pushed, the cord 250 attached at the second location 237 may push the second pulley 262 to rotate in a first direction and the cord 250 attached to the fourth location 239 may pull the second pulley 262 in the first direction. Conversely, when a back side of the user control interface 230 is pushed, the cord 250 attached at the fourth location 239 may push the second pulley 262 to rotate in a second direction opposite the first direction and the cord 250 attached to the second location 237 may pull the second pulley 262 in the second direction.

Referring to FIG. 7, the bidet assembly 200 may further include a plurality of cables 270. Each cable 270 may extend from the pulley assembly 260 to the bidet wand 220. In some examples, as illustrated in FIG. 7, a cable 270 may extend from each pulley (e.g., first pulley 261, second pulley 262) in the pulley assembly 260 to the bidet wand 220. Specifically, one end (e.g., a first end) of each cable 270 may be attached to the pulley assembly (e.g., first pulley 261, second pulley 262). In some examples, a sheath may surround each of the cables 270. A sheath may surround each of the cables 270. Each cable 270 may free to move within the sheath and the sheath may direct or guide the cable 270 as the cable 270 moves within the sheath. Specifically, the sheath may direct the cable such that the cable may apply a pushing force to the bidet wand 220.

Figure 10:
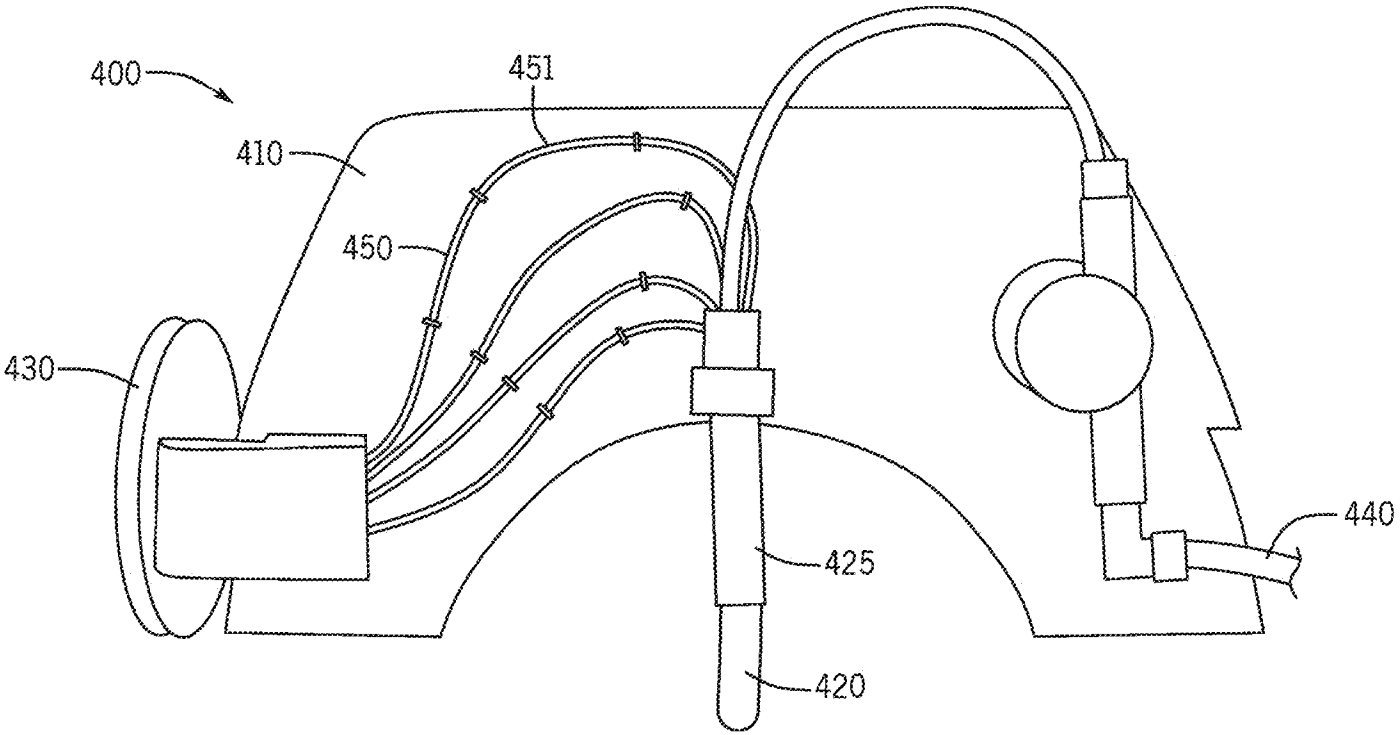
FIG. 10 illustrates a bottom view of the bidet assembly of FIG. 9 in accordance with one example of the present disclosure.
Figure 12:
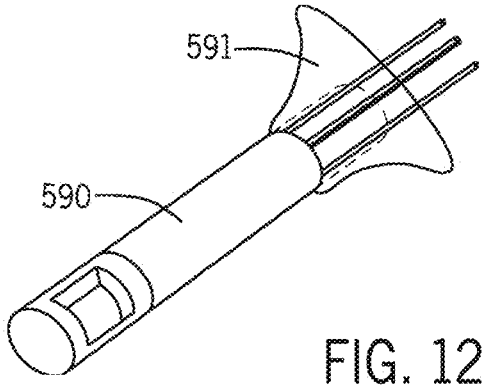
FIGS. 12-18 illustrate flexible sleeves in accordance with various examples of the present disclosure.
Figure 13:
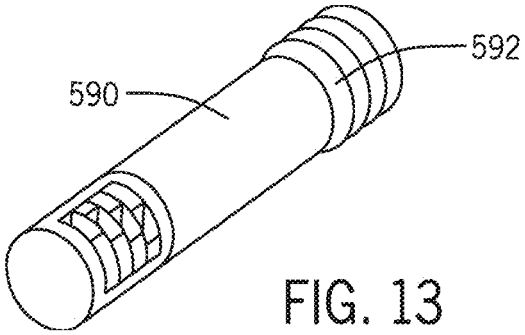
Figure 14:
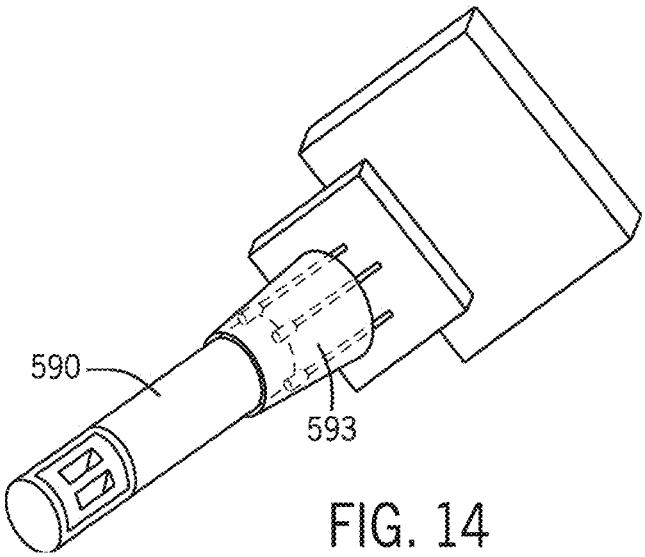
Figure 15:
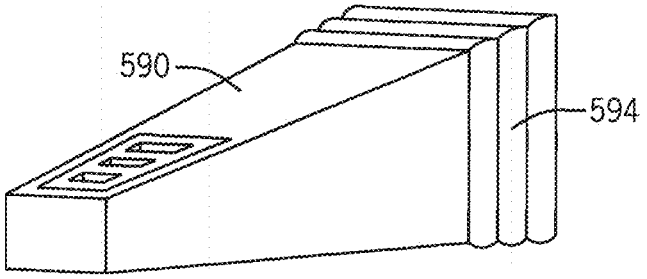
Figure 16:
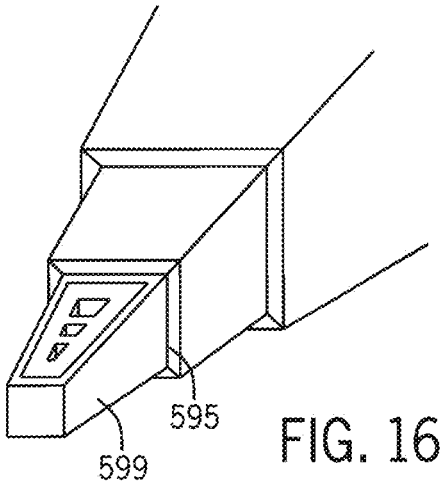
Figure 17:
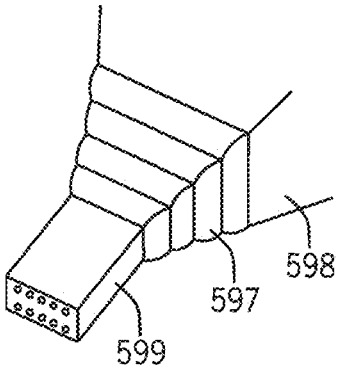
Figure 18:
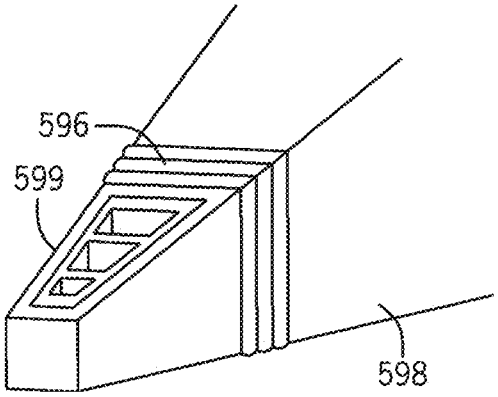

Another end (e.g., second end) of each of the cables 270 may be attached to the bidet wand 220. Each of the cables 270 may be connected to the bidet wand 220 at a different location. For example, one of the cables may be attached to the bidet wand 220 near a top or a bottom of the bidet wand 220 and another of the cables may be attached to the bidet wand 220 near a left or a right side of the wand 220. The bidet wand 220 may be attached or coupled to the base 210 of the bidet assembly using an elastic of flexible member. For example, an elastic or flexible sleeve 425 as shown in FIG. 10 may be disposed between the base 210 and the wand 220. Further, as illustrated in FIG. 12 described below, an elastic sleeve may be disposed between the bidet wand 220 and the base 210. The elastic sleeve may be configured to couple the bidet wand 220 to the base 210 so that the bidet wand 220 is free to move when a force is applied to the bidet wand 220. Further, the elastic sleeve may be configured to return the bidet wands 220 to an original or starting position when a force is not applied to the bidet wand 220 by the cables. For example, an elastic sleeve (e.g., 425) may be deformed as a user operates the user control interface 230, moving the wand 220 and when a user releases the user control interface 230 and elastic force of the elastic sleeve (e.g., 425) returning to its original or undeformed state may return the bidet wand 220 to its original or starting position.

Each of the cables 270 may be configured to move of the bidet wand about an axis (e.g., a vertical or horizontal axis). For example, a cable 270 attached to the first pulley 261 may be attached to the bidet wand at or near the top or bottom of the bidet wand 220 and may be configured to move the bidet wand along a vertical axis. Specifically, when the first pulley 261 rotates, the cable 270 extending from the first pulley 261 may either push or pull on the bidet wand 220 at or near the top or bottom of the bidet wand causing the bidet wand 220 to move upward or downward. For example, when a cable 270 attached at or near a top of the bidet wand pushes the bidet wand 220, the bidet wand 220 may move downward. Conversely, when a cable 270 attached to a top of the bidet wand 220 pulls bidet wand 220 the wand may move upward. In another examples, when a cable attached at or near a bottom of the bidet wand 220 pushes on the bidet wand 220, the bidet wand 220 may move upward and when a cable attached at or near a bottom of the bidet wand 220 pulls on the bidet wand 220, the bidet wand may move downwards.

In another example, a cable 270 attached to the second pulley 262 may be attached to the bidet wand 220 at or near a left or a right side of the bidet wand 220 and may be configured to move the bidet wand about a horizontal axis. Specifically, when the second pulley 262 rotates, the cable 270 extending from the second pulley may either push or pull the on the bidet wand 220 at or near a left or a right side of the wand 220 causing the wand 220 to move left or right (e.g., along a horizontal axis). The elastic sleeve may facilitate movement of the bidet wand 220 along the horizontal axis. For example, when a cable 270 attached at or near a left side bidet wand pushes the bidet wand 220, the bidet wand 220 may move to the right. Conversely, when a cable 270 attached to a left side of the bidet wand 220 pulls bidet wand 220 the wand may move to the left. In another examples, when a cable attached at or near a right side of the bidet wand 220 pushes on the bidet wand 220, the bidet wand 220 may move to the left and when a cable attached at or near a right side of of the bidet wand 220 pulls on the bidet wand 220, the bidet wand may move to the right.

Accordingly, when a user operates the user control interface 230, for example, pushing a side of the user control interface 230, one of the cords 250 may pull on a pulley (e.g., first pulley 261, second pulley 262) and another cord 250 may push on the pulley, causing the pulley to rotate. As the pulley rotates, the cable 270 attached to the pulley may move. As the cable 270 moves it may either push or pull on the bidet wand 220 causing it to move. In some examples, the user control interface 230 may be operated such that multiple sides of the user control interface 230 are moved (e.g., pushed) causing the bidet wand 220 to be displaced along both a vertical and a horizontal axis. For example, a top side and a front side of the user interface may be pushed causing the bidet wand to move (e.g., be displaced) upward and to the right.

Still referring to FIG. 7, in some examples, a flexible or elastic sleeve (e.g., elastic sleeve 425) may couple a wand end or tip 221 (e.g., wand cap) to the wand body 222. In these examples, the plurality of cables 270 may extend from the pulley assembly 260 to the wand end 221 and may cause the wand end 221 to move independently of the wand body 222. In these examples, operation of the user interface 230 may cause the wand end 221 to move in the same manner as the wand 220 moves as described above.

Figure 8:
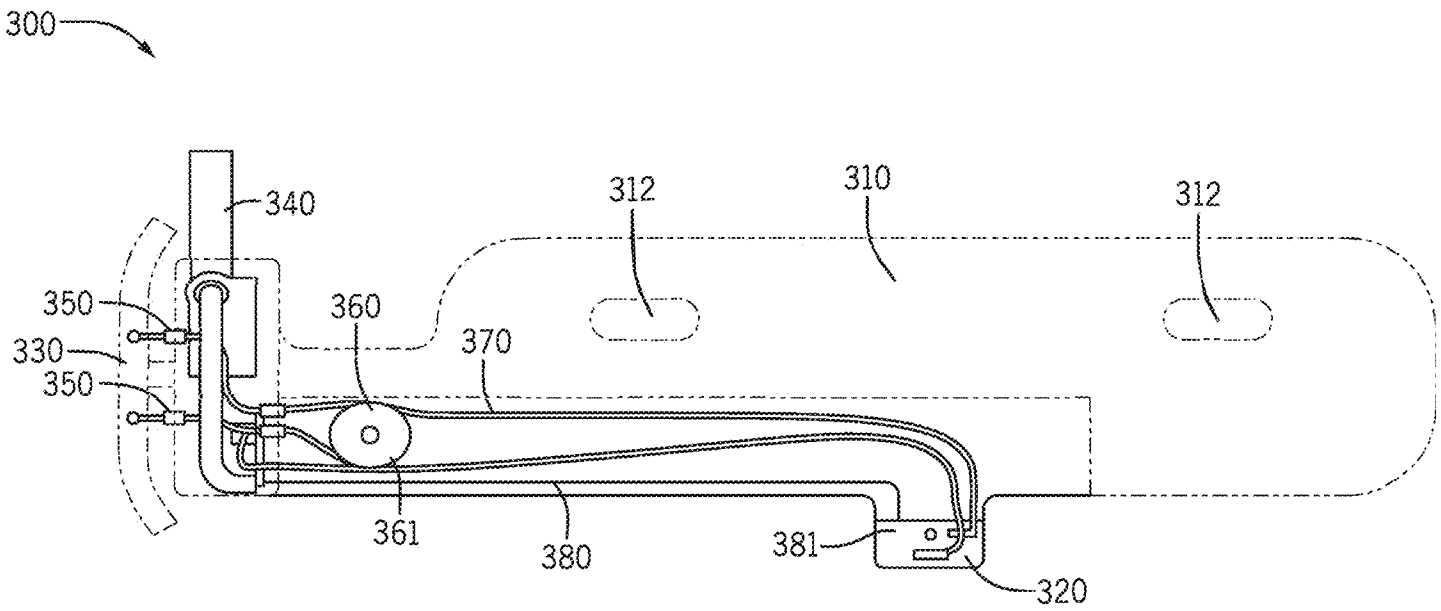
FIG. 8. Illustrates a bottom view of a bidet assembly in accordance with one example of the present disclosure.

Referring to FIG. 8, a bottom view of a bidet assembly 300 in accordance with another examples of the present disclosure is illustrated. As illustrated in FIG. 8, the bidet assembly 300 includes a base 310, a wand 320, a user control interface 330, a supply hose 340, mounting holes 312, a plurality of cords 350, a pulley assembly 360, and a cable 370. The base 310, wand 320, user control interface 330, and mounting holes 312 may be the same as the base 210, wand 220, and user control interface 230 described above with respect to FIG. 7. The supply hose 340 may be the same as the supply hose 140 described above with respect to FIGS. 4-6. As shown in FIG. 8, the bidet assembly 300 may include a base channel 380 disposed within the base 310 extending between and in fluid communication with the supply hose 340 and the wand inlet 381. The mounting holes 312 may be the same as the mounting holes 112 described above with respect to FIG. 6.

The plurality of cords 350 may be the same as the plurality of cords 250 described above with respect to FIG. 7; however, as illustrated in FIG. 8, the plurality of cords 350 only includes two cords 350. As described above, the plurality of cords 350 may extend from the user control interface 330 to the pulley assembly 360. Additionally, as described above, the plurality of cords 350 may be attached to different locations on the user control interface 330. The pulley assembly 360 may be the same as the pulley assembly 260 described above with respect to FIG. 7; however, as illustrated in FIG. 8, the pulley assembly 360 only includes a single pulley (e.g., first pulley 361). Additionally, the cable 370 may be the same as one of the plurality of cables 270 as escribed above with respect to FIG. 7. However, as illustrated in FIG. 8, the bidet assembly 300 only includes a single cable 370.

Similar to as described above with respect to FIG. 7, the one end (e.g., a first end) of each cord 350 may be attached to a different location or position of the user control interface 330. For example, each cord 350 may be attached to a location corresponding to or nearest to a different side of the user control interface 330. For example, each cord 350 may be attached to a different one of a location corresponding to a top side, a location corresponding to a front side, a location corresponding to a bottom side, and a location corresponding to a back side. In some examples, the cords 350 may be attached to locations corresponding to opposite sides of the user control interface 330. For example, as illustrated in FIG. 8, one of the cords 350 may be attached to a location corresponding to a front of the user control interface 330 and the other cord may be attached to a location corresponding to a back of the user control interface 330. In other examples, the cords 350 may be attached to locations corresponding to a top side and a bottom side of the user control interface 330, respectively.

Another end (e.g., second end) of each of the cords 350 may be attached to the pulley assembly 360, specifically to the first pulley 361. Each of the plurality of cords 350 may be attached to an opposite side of the first pulley 361. In some examples, cords 350 attached to opposite sides of the user control interface 330 may be attached to opposite sides of the first pulley 361. As described above, when the user control interface 330 is operated or moved each cord 350 may push or pull on the first pulley 361 causing the first pulley 361 to rotate. When opposite sides of the user control interface 330 are pushed, the first pulley 361 may rotate in opposite directions. An elastic or flexible sleeve disposed between the base 310 and the wand 320 or the wand body (e.g., 322) and the wand end (e.g., 321) may facilitate movement of the wand 320 and/or the wand end, respectively.

In some examples, the cable 370 may extend between the first pulley 361 and the bidet wand 320. In other examples, the cable 370 may extend between the first pulley 361 and a wand end (e.g., wand end 221). As the first pulley 361 moves, the cable 370 may push or pull the bidet wand 320 or wand end, causing the wand 320 or wand end, respectively, to move. Similar to as described above, the cable may be attached to the wand 220 or wand end at a location corresponding or nearest to a top, bottom, left, or right side of the wand 220 or wand end. When the cable 370 pushes the wand 320 or wand end, the wand or wand end may move in a direction opposite the side of the wand 320 or wand end to which the cable is attached. When the cable 370 pulls the wand 320 or wand end, the wand 320 or wand end may move in the direction of the side to which the cable is attached.

Figure 9:
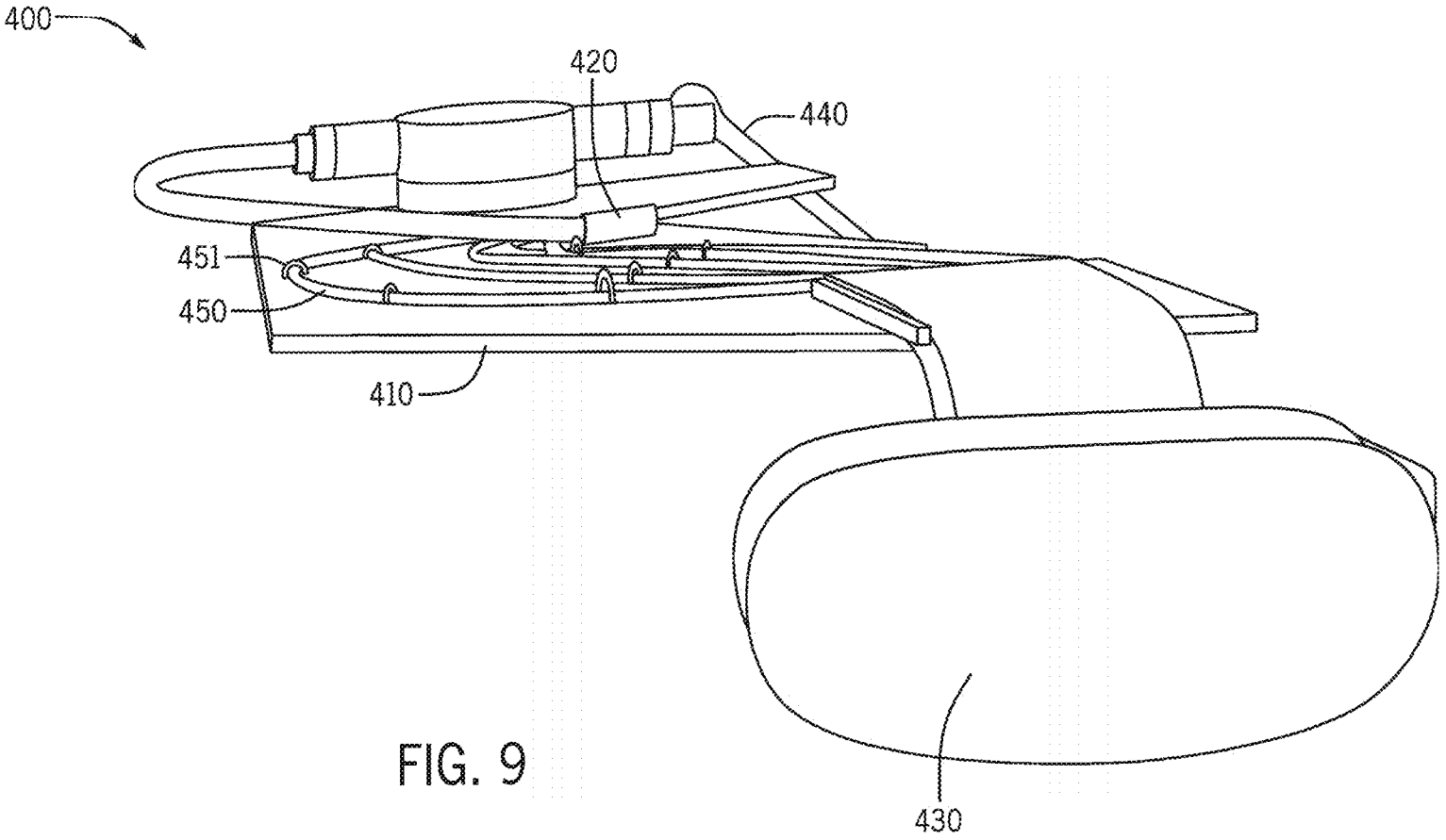
FIG. 9 illustrates a side perspective view of a bidet assembly in accordance with on example of the present disclosure.

Referring to FIG. 8, each of the cords 350 and or the cables 370 may be surrounds by a sheath (e.g., sheath 451 illustrated in FIGS. 9 and 10). As described above, the cord 350 and/or the cables 370 may free to move within the sheaths. Further, the sheaths may direct the cords 350 and/or the cables 370 as the cords 350 and/or cables move.

Referring generally to FIGS. 9 and 10, a bidet assembly 400 in accordance with another example of the present disclosure is illustrated. FIG. 9 illustrates a sideview and FIG. 10 illustrates a bottom view of the bidet assembly 400. As illustrated in FIGS. 9 and 10, the bidet assembly 400 includes a base 410, a wand 420, a user control interface 430, and a supply hose 440. The base 410, wand 420, and user control interface 430 may be the same as the base 210, wand 220, and user control interface 230 described above with respect to FIG. 7. The supply hose 440 may be the same as the supply hose 140 described above with respect to FIGS. 4-6.

As illustrated in FIGS. 9 and 10, the bidet assembly 400 further includes a plurality of cords 450. In some examples, as illustrated in FIGS. 9 and 10, the bidet assembly 400 may include four cords 450. However, the present disclosure is not limited thereto and the number of cords 450 may vary. Each of the plurality of cords 450 may extend from the user control interface 430 to the bidet wand 420. Specifically, one end (e.g., a first end) of each of the plurality of cords 450 may be attached to a different location or position on the user control interface 430. Each of the plurality of cords 450 may be attached to a location corresponding (e.g., nearest to) a different side of the user control interface 430. For example, each of the plurality of cords 250 may be attached to a different location of the user control interface 430 corresponding to one of a top side, front side, bottom side, or back side of the user control interface 430.

In some examples, each of the plurality of cords 450 may be surrounded by a sheath 451. Each cord may be free to move within the sheath 451. Each sheath may be configured to direct a cord 450 as the cord 450 moves within the sheath 451. Specifically, the sheath 451 may direct or control movement of the cord 450 such that cord 450 may apply a pushing force (e.g., to the wand 420).

Another end (e.g., second end) of the cord 450 may be attached to the wand 420. Each of the plurality of cords 450 may be attached to the wand 420 at a location corresponding (e.g., nearest) to a different side of the wand 420. For example, each of the plurality of cords 450 may be attached to the wand at a location corresponding to a different one of a top, right, bottom, and left side of the bidet wand 420. In some examples, cords 450 attached to opposite sides of the user control interface 430 may be attached to opposite sides of the bidet wand 420.

Similar to as described above with respect to FIG. 4, the bidet assembly 400 may further include a flexible or elastic sleeve 425. As described above, the elastic sleeve 425 may be disposed between the base 410 and the wand 420 of the bidet assembly and may facilitate movement of the bidet wand 420 when the user control interface 430 is operated. The elastic sleeve 425 is described in greater detail below with reference to FIG. 12.

Referring to FIGS. 9 and 10, in the bidet assembly 400 each of the plurality of cords may directly couple the user control interface 430 to the bidet wand 420. As a user operates or moves the user control interface 430, one or more of the plurality of cords 450 may move with the user control interface 430. As one or more of the plurality of cords 450 moves, it may apply a force to the bidet wand 420, moving the bidet wand 420. Specifically, the each of the plurality of cords 450 may either apply a pushing or a pulling force on the bidet wand 420. When a pushing force is applied to the wand 420, the wand 420 may move in a direction opposite of the side of the wand 420 to which the cord 450 is attached. Conversely, when a pulling force is applied to the wand 420, the wand 420 may move in the direction of a side of the wand 420 to which the cord 450 is attached. Accordingly, opposite forces applied to the bidet wand 420 by one of the plurality of cords 450 at the same location may cause the bidet wand to move in opposite directions about the same axis. Accordingly, a user may operate the user control interface 430 to selectively control a position of the bidet wand 420. Similar to the embodiment of FIG. 7 described above, when a user releases the user control interface 430, an elastic force of the elastic sleeve (e.g., returning to an original or undeformed state) may return the bidet wand 420, plurality of cords 450 and user control interface to a starting position (e.g., when no force is applied to the user control interface).

In some examples, similar to as described above with respect to FIG. 7, the bidet wand 420 may include a wand body and a wand end that is free to move independently of the wand end. Additionally, as described above, an elastic or flexible sleeve may be disposed between the wand body and the wand end, facilitating movement of the wand end relative to the wand body. In these examples, each of the plurality of cords 450 may extend between the user control interface 430 and the wand end. Specifically, each of the plurality of cords 450 may be attached to different locations corresponding to different sides of the wand end. In these examples, when the user control interface 430 is operated, each cord may apply a pushing or pulling force to the wand end causing the wand end to move. When a pushing force is applied to the wand end, the wand end may move in a direction opposite of the side of the wand end to which the cord 450 is attached. Conversely, when a pulling force is applied to the wand end, the wand end may move in the direction of a side of the wand end to which the cord 450 is attached.

Figure 11:
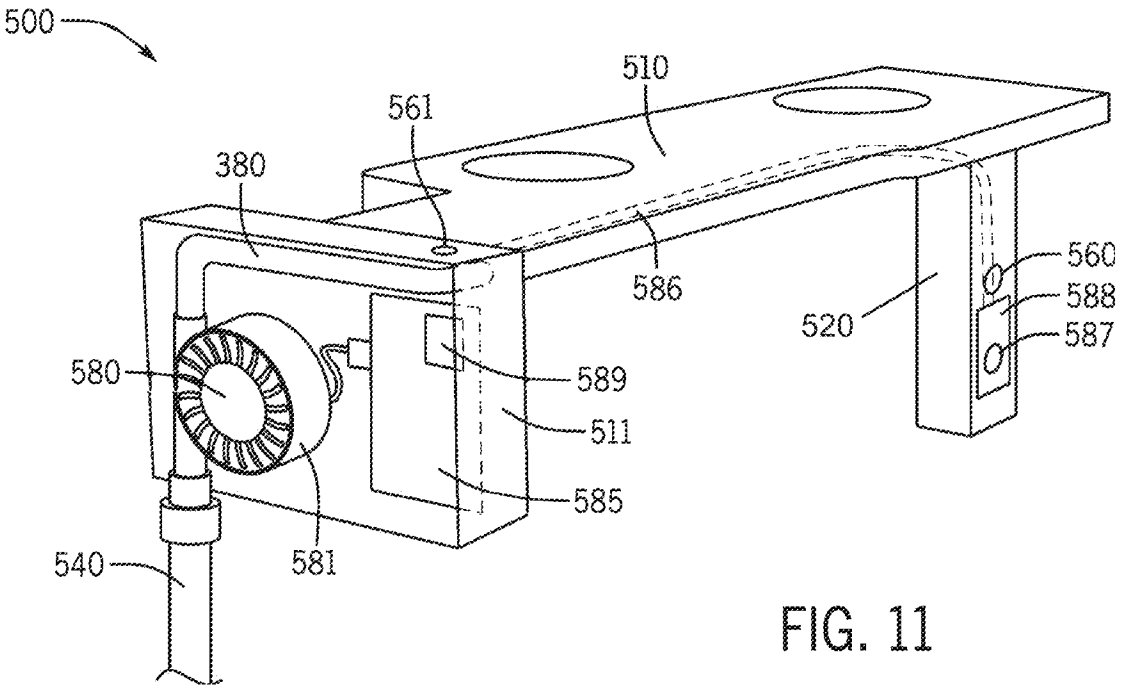
FIG. 11 illustrates a perspective view of a bidet assembly according to one example of the present disclosure.

Referring to FIG. 11, a bidet assembly 500 including a power generation turbine 580 is illustrated. The bidet assembly 500 includes a base 510, a wand 520, and supply hose 540. The base 510, wand 520, and supply hose 540 may be the same as the base 110, wand 120, and supply hose 140 described above with respect to FIGS. 4-6. In some examples, the base 510 may include a channel or base channel 380 configured to direct or conduct a flow of water from a channel inlet to a channel outlet or wand inlet (e.g., 381). The supply hose 540 may extend from a water supply to the channel inlet, fluidly connecting the water supply and the channel. The channel outlet may be in fluid communication with an internal cavity of the wand configured to direct or convey water from the channel outlet to an outlet of the wand.

As illustrated in FIG. 11, the bidet assembly 500 includes a power generation turbine 580. The turbine 580 may be disposed in the pathway of a flow of water from the supply hose 540 to the bidet wand 520. For example, the turbine 580 my be disposed in the pathway of water flowing through the base channel 380. In some examples, the turbine 580 may further include a turbine housing 581. In some examples, as illustrated in FIG. 11, the turbine 580 may be disposed in the turbine housing 581 such that only some of the blades of the turbine are disposed in the pathway of the flow of water through the channel. The turbine 580 may include one or more magnets and coils and may be configured to generate power as water flows past the turbine, rotating the turbine. In some examples, the turbine 580 may be disposed in a vertical portion 511 of the base 510. The turbine 580 may be included in other positions, for example, the turbine may be disposed in a horizontal portion of the base 110 supported by the pedestal 31.

In some examples, the turbine 580 may be electrically connected to a control circuit 585. The control circuit 585 may be configured to selectively supply power (e.g., electric current) to one or more electrical components in the bidet assembly 500. For example, as illustrated in FIG. 11, the control circuit may be configured to selectively supply power to an ultraviolet (UV) light 587 disposed at or near an end of the wand 520. In some examples, the bidet assembly 500 may include one or more buttons, switches, and/or sensors (e.g., capacitive) in communication with the control circuit 585. Each button, switch, and/or sensor may be configured to send a signal to the control circuit to activate and/or deactivate an electrical component included in the bidet assembly 500. The control circuit 585 may be configured to supply power (e.g., current) to an electrical component, for example, UV light 587 in response to operation of the button, switch, or sensor. Further, the button may be configured to stop supplying power to the electrical component in response to a second or subsequent operation of the button, switch, or sensor. In some examples, the control circuit 585 may supply power to the electrical component, for example, a UV light 587, while water is dispensed from the wand 520. In some examples, the control circuit 585 may include a communication interface configured to receive wireless communications (e.g., from a computer or smart phone) for controlling the supply of power to one or more electrical components included in the bidet assembly 500.

In some examples, the bidet assembly 500 may further include a battery 589. The battery 589 may be electrically connected to the turbine 580 and/or the control circuit 585. As water flows past the turbine 580, rotating the turbine 580 and causing the turbine 580 to generate power, power or electric current generated by the turbine 580 may flow to the battery 589, charging the battery 589. The battery 589 may be configured to store power generated by the turbine and provide stored power to one or more of the electrical components included in the bidet assembly 500. The control circuit 585 my control the flow of power from the battery 589 to one or more electrical components included in the bidet assembly 500.

In some examples, the bidet assembly 500 may further include an indicator or status light indicating that power is being supplied (e.g., from the turbine 580, from the battery) to an electrical component included in the bidet assembly 500. For example, a light emitting diode (LED) may illuminate when power is being supplied to an electrical component (e.g., UV light 587). An indicator light may be provided for each electrical component included in the bidet assembly 500.

As described above, in some examples, the bidet assembly 500 may include a UV light 587. As illustrated in FIG. 11, in some examples, a wire 586 may extend between the control circuit 585 and a printed circuit board (PCB) 588 including the UV light 587. The UV light 587 may be disposed at or near an end of the wand 520. The UV light 587 may irradiate water within the wand 520 disinfecting the water before it is dispensed from an outlet of the wand 520. In some examples, the control circuit 585 may control the flow of power to the UV light 587. In other examples, the UV light 587 may be electrically connected to the turbine such that any time the turbine 580 generates power (e.g., anytime water flows through the turbine) the UV light 587 is illuminated.

Figure 20:
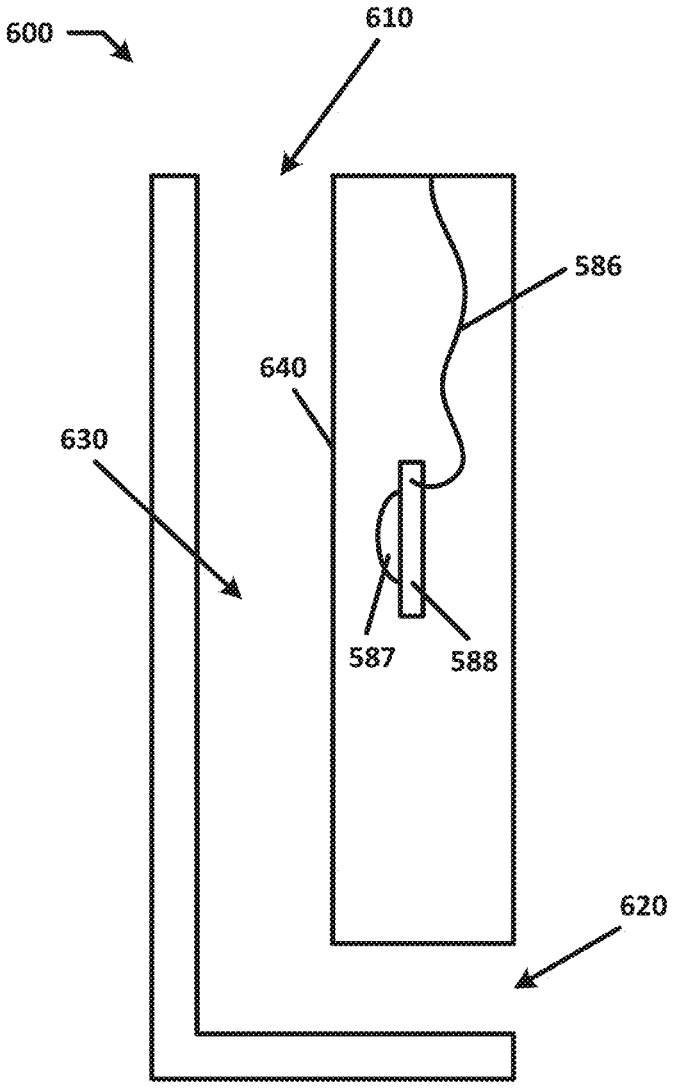
FIG. 20 illustrates a cross-sectional view of a bidet wand in accordance with one example of the present disclosure.

Referring to FIG. 20, a cross-sectional view of a bidet wand 600 including a UV light 587 is illustrated in accordance with one example of the present disclosure. The wand 600 may be the same as or substantially similar to any of the wands 120, 220, 320, 520 described herein. The wand 600 may include a wand inlet 610 in communication with a base channel (e.g., 380), a wand outlet 620, and a wand channel 630 extending between the wand inlet 610 and the wand outlet 620. The wand outlet 620 may be the same as or substantially similar to the wand outlet 121.

As shown in FIG. 20, the UV light 587 may be disposed within the wand 600. The UV light 587 may be configured to illuminate or irradiate water flowing through the wand channel 630, disinfecting the water before it is dispensed from the wand 600. In some examples, as illustrated in FIG. 20, the UV light 587 may be disposed in the housing and a wall 640 or a portion of a wall of the wand channel 630 may be comprised of a transparent material, such that ultraviolet light emitted or irradiated by the UV light 587 may travel through the wall 640 of the wand channel 630, into the wand channel 630, disinfecting water flowing through the wand channel 630. For example, a wall 640 or a portion of the wall 640 may be comprised of glass, a transparent plastic, or the like. In some examples, a wall of the wand channel 630 (e.g., disposed adjacent to the UV light 587) may include a window comprised of a transparent material, such that water flowing through the wand channel 630 may be illuminated or irradiated by ultraviolet light emitted by the UV light 587. In other examples, the UV light 587 may be disposed within the wand channel 630.

As shown in FIG. 20, the UV light 587 may be coupled to a PCB 588 disposed within the wand 600. A wire 586 may connect the UV light 587 and/or the PCB 588 to the control circuit 585. As noted above, in some examples, the control circuit 585 may selectively supply power to the UV light 587. Specifically, the control circuit 585 may selectively provide power generated by the turbine 580 to the UV light 587. The control circuit 585 may supply power generated by the turbine 580 directly (e.g., without being stored in a battery 589) to the UV light 587 or may supply power generated by the turbine 580 and stored in the battery 589 to the UV light 587. In some examples, power is automatically supplied to the UV light 587 when the turbine 580 generates power.

In another example, the bidet assembly 500 may include a fan. The fan may be configured to blow air on a user, drying the user. In some examples, a fan may be operated after water is dispensed from the outlet of wand. For example, power stored in a battery may be supplied to the fan after water has been dispensed from the bidet wand. Specifically, the battery may store power and supply it to the fan after water has been dispensed and at a time at which the turbine is no longer generating power.

In another example, the bidet assembly 500 may include a heater. The heater may include a heating element (e.g., electrical heating element) configured to increase the temperature of the water dispensed from the outlet of the water. The heater may be electrically connected to the control circuit 585. In some examples, the battery may supply power to the heater. In other examples, the heater may be configured to increase the temperature of air blown (e.g., by a fan) on a user.

In another example, referring to FIG. 11, the bidet assembly 500 may include a guide or night light 560. In some examples, the guide light 560 may include a light emitting diode (LED). In other examples, the guide light 560 may include an incandescent bulb, a compact fluorescent lamp (CFL), or a halogen lamp. The guide light 560 may be configured to illuminate an area proximate to the bidet wand 520. For example, the guide light 560 may be configured to illuminate a bowl (e.g., 23, 32) of a toilet. The guide light 560 may be disposed at or on an exterior surface of the wand 520. In some examples, the guide light 560 may be disposed along the length of the wand 520. The guide light 560 may face and be configured to illuminate the front, back, or a side of a toilet bowl (e.g., 23, 32). In some examples, the guide light 560 may be disposed at an (e.g., distal) end of the wand 520.

The guide light 560 may be electrically connected to the control circuit 585, turbine 580, and/or battery 589. The control circuit 585 may selectively provide power directly (e.g., without being stored in the battery 589) from the turbine 580 and/or from the battery 589 to the guide light 560. According to some examples, the control circuit 585 may control the guide light 560 to illuminate during a predetermined or predetermined periods of time. The control circuit 585 may control the guide light 560 (e.g., an on/off state) by selectively providing current to the guide light 560 and/or using one or more control signals. In some examples, the control circuit 585 may include a clock and control the guide light 560 to illuminate at night.

In another example, the bidet assembly 500 may further include a light sensor 561. The light sensor 561 may be for example, a photodiode, phototransistor, photoresistor, or photovoltaic light sensor. The light sensor 561 may be configured to detect a lighting condition at the bidet assembly 500 and/or at a toilet including the bidet assembly 500. The light sensor 561 may be connected to the control circuit 585 and configured to send one or more signals indicative of a lighting condition to the control circuit 585. As shown in FIG. 11, the light sensor 561 may be included in the base 510 of the bidet assembly 500. For example, the light sensor 561 may be included in the base 510 so as to detect a lighting condition at a toilet including bidet assembly 500 when a toilet seat cover is in a closed position. In other examples, the light sensor 561 may be included in the wand 520 of the bidet assembly 500. In these examples, the control circuit 585 may control the guide light 560 to illuminate when a predetermined lighting condition (e.g., less than a threshold illuminance) is detected by the light sensor 561. For example, the control circuit 585 may control the guide light 560 to illuminate when the light sensor 561 indicates that it is dark at the bidet assembly 500 and/or toilet including the bidet assembly 500.

In some examples, the bidet assembly 500 may further include a valve and a bypass channel. The valve may be configured to selectively divert the flow of water through the bidet assembly 500 around the turbine 580 such that the turbine does not generate power. In some examples, the valve may be an electric (e.g., solenoid) valve and one or more buttons, switches, or sensors may send signals to the control circuit 585 for controlling a position of the valve. In other examples, the valve may be a manual valve.

FIGS. 12-18 illustrates various elastic sleeves in accordance with several examples in accordance with the present disclosure. Specifically, FIGS. 12-18 illustrates elastic sleeves 591-597 in accordance with various examples of the present disclosure. In some examples, the elastic sleeves 591-594 may be disposed between a base (e.g., base 110) and a bidet wand 590. The bidet wand 590 may be the same as the bidet wand 120 described above with respect to FIGS. 4-6. Further, as described above with respect to FIGS. 4-6, the shape and size of the bidet wand 590 may vary. In other examples, the elastic sleeves 595-597 may be disposed between a wand body 598 and a wand end 599. The wand body 598 and the wand end 599 may be the same as the wand body 222 and the wand end 221 as described above with respect to FIG. 7.

Further, as illustrated in FIGS. 12-18, the size and/or shape of the elastic sleeve may vary. For example, the elastic sleeve may have a frusto-conical shape, a cylindrical shape, a frusto-pyramidal shape, and the like. However, the present disclosure is not limited thereto, and other shapes of the elastic sleeve are possible.

Figure 19:
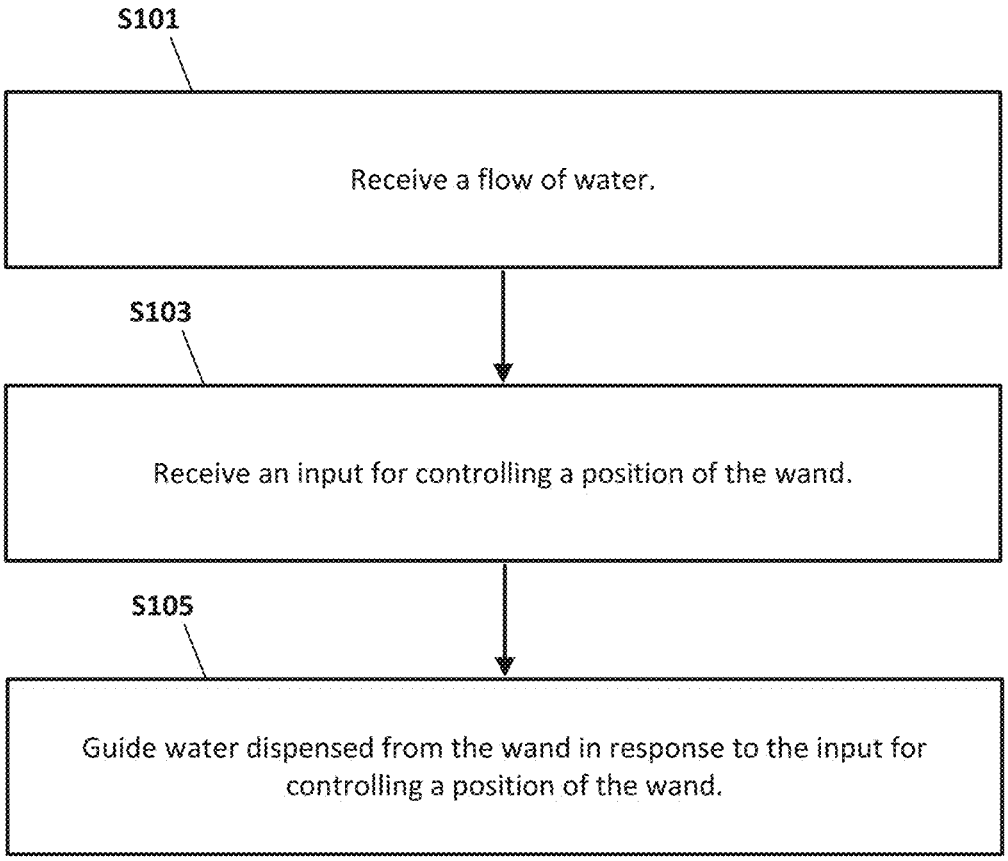
FIG. 19 illustrates a flow chart for operating a bidet assembly in accordance with one example of the present disclosure.

FIG. 19 illustrates a flow chart for operating a bidet assembly in accordance with one example of the present disclosure. The flow chart for operating a bidet assembly as illustrated in FIG. 19 may be used with any of the bidet assemblies 100, 200, 300, 400, and 500 described herein. Additional, different, or fewer acts may be provided.

In a first act S101, a flow of water is received by the bidet wand (e.g., wand 120). In some examples, a supply hose (e.g., supply hose 140) may supply water to the bidet wand. The bidet wand may receive water via a wand inlet. In some examples, the supply hose may be in fluid communication with a tank (e.g., tank 36) of the toilet so as to be supplied with water from the tank during a flush cycle. For example, the supply hose may be in fluid communication with a flush valve disposed in the tank or a rim channel of the toilet so as to receive water stored in the tank during a flush cycle. In other examples, the supply hose may be in fluid communication with a (building) plumbing network and a valve may control a flow of water from the plumbing network into the supply hose and thus received by the bidet wand.

In a second act S103, an input for controlling a position of the wand is received. In some examples, the input for controlling a position of the wand may be a force applied to the wand. For example, the input may be a pushing or pulling force applied to the bidet wand. The pushing or pulling force applied to the wand may move or change a position of the wand. In some examples, a force or forces may be applied to the wand causing the wand to move along two difference axis, for example, along a vertical and a horizontal axis. In an example, a force applied the wand may cause the wand to move upward along a vertical axis and to the right along a horizontal axis.

In some examples a force or forces may be applied to the wand by one or more cords (e.g., cords 450). The one or more cords may extend between a user control interface (e.g., user control interface 430) and the wand. Accordingly, in these examples, when a user operates or moves the user control interface, the one or more cords may move, and a force (e.g., pushing or pulling) may be applied to the wand via the one or more cords. In other examples, a force or forces may be applied to the wand by one or more cables (e.g., cables 270). The one or more cables may extend between a pulley assembly (e.g., pulley assembly 260) and the wand. In these examples, when a user operates the user control interface, one or more cords (e.g., cords 250) may move a pulley or pulleys of the pulley assembly, moving the one or more cables and a force may be applied to the wand via the one or more cables. In some examples, the wand may receive an input (e.g., force) for controlling a position of the wand for a duration of time during which a flow of water is received and/or dispensed by the wand.

In a third step S105, water dispensed from the wand is guided in response to the input for controlling a position of the wand. For example, water dispensed from the wand may be guided so as to contact a user at a desired location (e.g., according to user preference). Water dispensed from the wand may be guided in response to the user input for controlling a position of the wand. Specifically, a position of the wand, as controlled by the input, may dictate a trajectory or pathway if water dispensed from the wand. Accordingly, water dispensed from the wand may be guided in response to the input for controlling a position of the wand.

In some examples, the flowchart for operating a bidet assembly in accordance with one example of the present disclosure may further include powering an electrical component of the bidet assembly (e.g., bidet assembly 500). For example, a power generation turbine (e.g., turbine 580) and/or a battery may power an electrical component included in the bidet assembly. In some examples, the turbine may power or charge the battery. An electrical component included in a bidet assembly may include, for example, a UV light, a fan, or a heater. In some examples, more than one electrical component may be included in the bidet assembly and more than one electrical component may be powered.

In some examples, an electrical component, for example, a UV light or heater may be powered for a duration of time corresponding to a duration of time during which water is received by the wand and/or a duration of time during which water dispensed by the wand is guided in response to the input for controlling a position of the wand. In other examples, the electrical component, for example, a fan, may be powered after the flow of water is received by the wand and/or water dispensed by the wand is guided in response to the input for controlling a position of the wand. In some examples, the flow chart for operating a bidet assembly in accordance with one example of the present disclosure may further include illuminating a status light for a duration of time corresponding to a duration of time during which the electrical component is powered.

When a component, device, element, or the like of the present disclosure is described as having a purpose or performing an operation, function, or the like, the component, device, or element should be considered herein as being "configured to" meet that purpose or to perform that operation or function.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

The term "or," as used herein, is used in its inclusive sense (and not in its exclusive sense) so that when used to connect a list of elements, the term "or" means one, some, or all of the elements in the list. Conjunctive language such as the phrase "at least one of X, Y, and Z," unless specifically stated otherwise, is understood to convey that an element may be either X, Y, Z; X and Y; X and Z; Y and Z; or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

Although the figures and description may illustrate a specific order of method steps, the order of such steps may differ from what is depicted and described, unless specified differently above. Also, two or more steps may be performed concurrently or with partial concurrence, unless specified differently above. Such variation may depend, for example, on the software and hardware systems chosen and on designer choice. All such variations are within the scope of the disclosure. Likewise, software implementations of the described methods could be accomplished with standard programming techniques with rule-based logic and other logic to accomplish the various connection steps, processing steps, comparison steps, and decision steps.

It is important to note that the construction and arrangement of the system as shown in the various exemplary embodiments is illustrative only. Additionally, any element disclosed in one embodiment may be incorporated or utilized with any other embodiment disclosed herein. Although only one example of an element from one embodiment that can be incorporated or utilized in another embodiment has been described above, it should be appreciated that other elements of the various embodiments may be incorporated or utilized with any of the other embodiments disclosed herein.

What is claimed is:

1. A bidet assembly comprising:
a base configured to be coupled to a toilet;
a wand extending from the base;
a user control interface coupled to the base; and
a plurality of cords extending from the user control interface to the wand, the plurality of cords configured to move the wand when the user control interface is moved.

2. The bidet assembly of claim 1, wherein the wand comprises a wand body and a wand end, the plurality of cords extending from the user control interface to the wand end.

3. The bidet assembly of claim 1, further comprising:
an elastic sleeve disposed between the base and the wand.

4. The bidet assembly of claim 3, wherein the elastic sleeve is configured to return the wand and the user control interface to a starting position when the user control interface is released.

5. The bidet assembly of claim 1, wherein:
one end of each of the plurality of cords is attached to a different location of the user control interface.

6. The bidet assembly of claim 5, wherein the plurality of cords comprises four cords.

7. The bidet assembly of claim 1, further comprising:
a channel in fluid communication with the wand; and
a turbine disposed along the channel, the turbine configured to generate power as water flows to the wand.

8. A toilet comprising:
a pedestal including a bowl; and a bidet assembly comprising:

a base coupled to the pedestal;

a wand extending from the base into the bowl;

a user control interface coupled to the base; and a plurality of cords extending from the user control interface to the wand, the plurality of cords configured to move the wand when the user control interface is moved.

9. The toilet of claim 8, wherein the wand comprises a wand body and a wand end, the plurality of cords extending from the user control interface to the wand end.

10. The toilet of claim 8, the bidet assembly further comprising:

a channel in fluid communication with the wand; and a turbine disposed along the channel, the turbine configured to generate power as water flows to the wand.

11. A method of operating a bidet assembly, the method comprising:

receiving a supply of water at a bidet wand;

receiving an input for controlling a position of the wand;

powering an electrical component included in the bidet assembly; and guiding, by a channel, water dispensed from an outlet of the wand to the outlet in response to the input for controlling a position of the wand.

12. The method of claim 11, wherein the electrical component is one of an ultraviolet light, a fan, or a heater.

13. The method of claim 11, further comprising:

illuminating a status light while the electrical component is powered.

* * * * *